US011660632B2

(12) United States Patent
Bertola

(10) Patent No.: US 11,660,632 B2
(45) Date of Patent: May 30, 2023

(54) DEVICE FOR COATING, IN PARTICULAR PAINTING, THE MAIN SURFACES OF RIGID PANELS WITH LIQUID PRODUCTS

(71) Applicant: Biemme Elettrica di Bertoia Massimo, Cessalto (IT)

(72) Inventor: Massimo Bertola, Cessalto (IT)

(73) Assignee: Ecosys S.R.L., Meduna di Livenza (IT)

( * ) Notice: Subject to any disclaimer, the term of this patent is extended or adjusted under 35 U.S.C. 154(b) by 271 days.

(21) Appl. No.: 17/042,538

(22) PCT Filed: Mar. 26, 2019

(86) PCT No.: PCT/IB2019/052459

§ 371 (c)(1),
(2) Date: Sep. 28, 2020

(87) PCT Pub. No.: WO2019/186402

PCT Pub. Date: Oct. 3, 2019

(65) Prior Publication Data

US 2021/0016314 A1 Jan. 21, 2021

(30) Foreign Application Priority Data

Mar. 28, 2018 (IT) ..... 102018000004048
Jan. 14, 2019 (IT) ..... 102019000000575

(51) Int. Cl.
*B05C 5/02* (2006.01)
*B05C 11/10* (2006.01)

(52) U.S. Cl.
CPC ..... *B05C 5/0254* (2013.01); *B05C 11/1039* (2013.01)

(58) Field of Classification Search
None
See application file for complete search history.

(56) References Cited

U.S. PATENT DOCUMENTS 5,976,256 A * 11/1999 Kawano ..... B05C 5/0254 118/684
6,139,639 A * 10/2000 Kitamura ..... B05C 5/0254 118/DIG. 2

(Continued)

FOREIGN PATENT DOCUMENTS

| | | |
|---|---|---|
| EP | 2 090 374 A1 | 6/2009 |
| JP | 2004-113954 | 4/2004 |
| WO | 95/29763 | 11/1995 |

OTHER PUBLICATIONS

International Search Report and Written Opinion dated Jul. 5, 2019, issued in PCT Application No. PCT/IB2019/052459, filed Mar. 26, 2019.

*Primary Examiner* — Jethro M. Pence
(74) *Attorney, Agent, or Firm* — Workman Nydegger

(57) ABSTRACT

Device for coating, preferably for painting, the main surfaces of rigid panels with liquid products includes a substantially horizontal support surface to support a rigid panel and a painting head placed orthogonally to the direction of relative movement and above the support surface. The painting head has, in sequence on its face facing the support surface, a dispensing outlet for a liquid product and a suction inlet for the liquid product so as to create a veil of liquid product. The first side surface of the face is configured so that the distance d4 between one of the points around the first end of the dispensing outlet and the support surface is smaller than the distance dx between any other point belonging to the face and the support surface.

17 Claims, 10 Drawing Sheets

(56) References Cited

U.S. PATENT DOCUMENTS

| | | | | |
|---|---|---|---|---|
| 6,258,167 | B1 * | 7/2001 | Kawano | B05B 15/50 118/667 |
| 6,467,893 | B1 * | 10/2002 | Matsumoto | B05C 9/06 347/73 |
| 6,540,833 | B1 * | 4/2003 | Gibson | B05C 13/00 118/712 |
| 7,438,763 | B2 * | 10/2008 | Kanke | B05C 5/007 118/DIG. 2 |
| 7,905,195 | B2 * | 3/2011 | Yamasaki | H01L 21/6715 198/689.1 |
| 8,079,662 | B2 * | 12/2011 | Nakajima | H01L 21/6715 414/781 |
| 8,196,543 | B2 * | 6/2012 | Nakajima | B41J 3/28 347/19 |
| 9,919,335 | B2 * | 3/2018 | Nalin | B05C 5/0254 |
| 9,951,450 | B2 * | 4/2018 | Joung | D06B 1/02 |
| 10,112,210 | B2 * | 10/2018 | Wakamoto | B05C 5/0208 |
| 2003/0118741 | A1 * | 6/2003 | Gibson | B05C 11/1013 427/427.2 |
| 2005/0120947 | A1 * | 6/2005 | Sone | B05B 7/0884 118/325 |
| 2006/0088700 | A1 * | 4/2006 | Miyasaka | G02B 5/201 118/326 |
| 2011/0189402 | A1 | 8/2011 | Wagner | |
| 2013/0330479 | A1 * | 12/2013 | Nonomura | H01L 21/67745 118/300 |
| 2013/0330480 | A1 * | 12/2013 | Nonomura | H01L 21/67178 118/300 |
| 2014/0008420 | A1 * | 1/2014 | Miyamoto | H01L 31/0322 118/66 |
| 2016/0186440 | A1 | 6/2016 | Florenske et al. | |
| 2021/0016314 | A1 * | 1/2021 | Bertoia | B05C 5/0254 |

* cited by examiner

DEVICE FOR COATING, IN PARTICULAR PAINTING, THE MAIN SURFACES OF RIGID PANELS WITH LIQUID PRODUCTS

BACKGROUND OF THE INVENTION

1. The Field of the Invention

The present invention relates to a device for coating, in particular for painting with liquid products, the main surfaces of rigid panels made of wood or other materials, such as for example chipboard or plastic materials.

In particular, the invention relates to a device for uniformly depositing a liquid coating substance, preferably paint, on the above-mentioned main surfaces of such panels.

2. The Relevant Technology

Parenthetically, in the present context, the term "panel" refers to a flat element in which two large surfaces parallel to each other are identified, defined below as main surfaces, between which there are lateral edges.

It is known that rigid panels made of wood or other material are suitably coated, preferably painted, to give the surfaces and edges a specific aesthetic appearance.

As regards, more specifically, the coating, or more specifically the painting of the main surfaces, this can be carried out manually, by means of one or more automated airbrushes, also called spray guns, installed on suitable structures below which the rigid panel passes, or, by means of one or more rollers resting on one of the main surfaces of the aforesaid rigid panel so as to transfer the liquid coating substance by contact. More specifically, as regards the above-mentioned airbrushes, each of them is equipped with a nozzle able to atomize the liquid product, more specifically the paint, towards the surfaces of the above-mentioned panels.

Obviously, the manual approach disadvantageously involves a high expenditure of time and does not ensure adequate precision in the distribution of the paint on the main surface.

Even the second approach which envisages the use of a plurality of spray guns does not lead to a uniform distribution of the paint over the entire main surface and, moreover, results in an increased waste of the atomized liquid substance since a good part of it is dispersed in the surrounding environment and is not deposited on the panel's surfaces.

Disadvantageously, this increases the level of pollution in the surrounding environment.

To overcome this last drawback, it is therefore necessary to place the painting device inside suitable painting booths isolated from the external environment and equipped with suction hoods to aspirate the sprayed product so as to avoid its diffusion into the environment. However, this solution requires considerable costs.

Furthermore, there is a huge economic loss due to the waste of the sprayed product that is not deposited on the panel's surfaces.

Moreover, this atomized liquid substance, disadvantageously, could accidentally be deposited also on the edges of the rigid panel, leading to the non-homogeneity of the paint layer present on the latter.

Finally, as regards the methodology which provides for the use of one or more rollers, it disadvantageously does not ensure the adequate distribution per square meter of the paint on the main surfaces of the rigid panel.

With regard to covering the edges, the prior art comprises the use of coating or painting devices comprising a painting head equipped with a reservoir, operatively connected by a delivery duct to a dispensing outlet located on the front of the painting head facing an edge of the panel. More specifically, this dispensing outlet has an essentially longitudinal development of a length at least equal to the thickness of the above-mentioned edge of the panel. In other words, this dispensing outlet is a longitudinal slot which defines a dispensing nozzle. Even more precisely, the position of the dispensing outlet is parallel with the direction of relative movement of the panel and of the painting head itself. In this way, when the panel passes, with this relative movement, close to the dispensing outlet, a coating layer is deposited homogeneously on it along its entire length.

These painting heads of the known type are also equipped, next to the dispensing outlet, with a suction inlet suited to aspirate the liquid product which comes out of the aforesaid dispensing outlet. This suction action facilitates the creation of a veil of liquid product between the dispensing outlet and the suction inlet suited to skim the edge of the panel, resulting in an amount of liquid product being laid which is sufficient to uniformly cover the edge itself and also prevents the runoff of the liquid product from the painting head.

In fact, the excess liquid product dispensed, and therefore not deposited on the edge of the moving panel (relative), is recovered by the suction inlet and returned to a reservoir for the liquid product.

In this way, the viscosity of the liquid product, the delivery rate through the slot, the speed of relative movement between the panel and the painting head, and the degree of vacuum at the suction point determine the thickness of the liquid product deposited on the edge of the panel.

From experimental tests carried out by the applicant, this last type of covering devices, disadvantageously, cannot be used also to cover, in particular to paint, the main surfaces of the rigid panel.

In fact, it is not sufficient to increase the length of the dispensing outlet and therefore the painting head at least to a value equal to the side of the panel perpendicular to the above-mentioned direction of relative movement, in order to obtain the at least sufficient quality painting of the main surfaces.

In particular, even if theoretically it would be intuitive to expect that an adequately dimensioned painting head facing one of the main surfaces might be used for the covering, in particular for the painting of the latter, in practice it has become clear that the distribution of the liquid product on the main surfaces, given that they are much more extensive than the edges, does not occur uniformly. This non-homogeneity, specifically, is found both in a parallel direction and in an orthogonal direction with respect to the above-mentioned direction of relative movement. More specifically, disadvantageously, using this type of devices, strips or bands are created on the main surface of the panel with an accumulation of liquid product greater than the accumulation that is found on adjacent strips or bands.

SUMMARY OF THE INVENTION

The present invention intends to overcome the aforesaid drawbacks.

More specifically, one object of the invention is to provide a covering device, in particular for painting, able to also distribute a liquid product on the main surfaces of a rigid panel.

Even more specifically, it is an object of the invention to provide a covering device, in particular for painting, able to uniformly distribute this liquid product on the above-mentioned main surfaces of a rigid panel.

These objects are achieved with the construction of a device in accordance with the main claim.

Further characteristics of the device of the invention are described in the dependent claims.

BRIEF DESCRIPTION OF THE DRAWINGS

The above objects, together with the advantages mentioned below, will be highlighted in the description of some preferred embodiments of the invention that are provided, by way of non-limiting examples, with reference to the attached drawings, where.

DETAILED DESCRIPTION OF THE PREFERRED EMBODIMENTS

The device of the invention for coating, preferably for painting, with liquid products, preferably paints, of the main surfaces of rigid panels, is shown according to a first embodiment in FIGS. 1 to 4, where it is indicated as a whole by 1.

Figure 1:
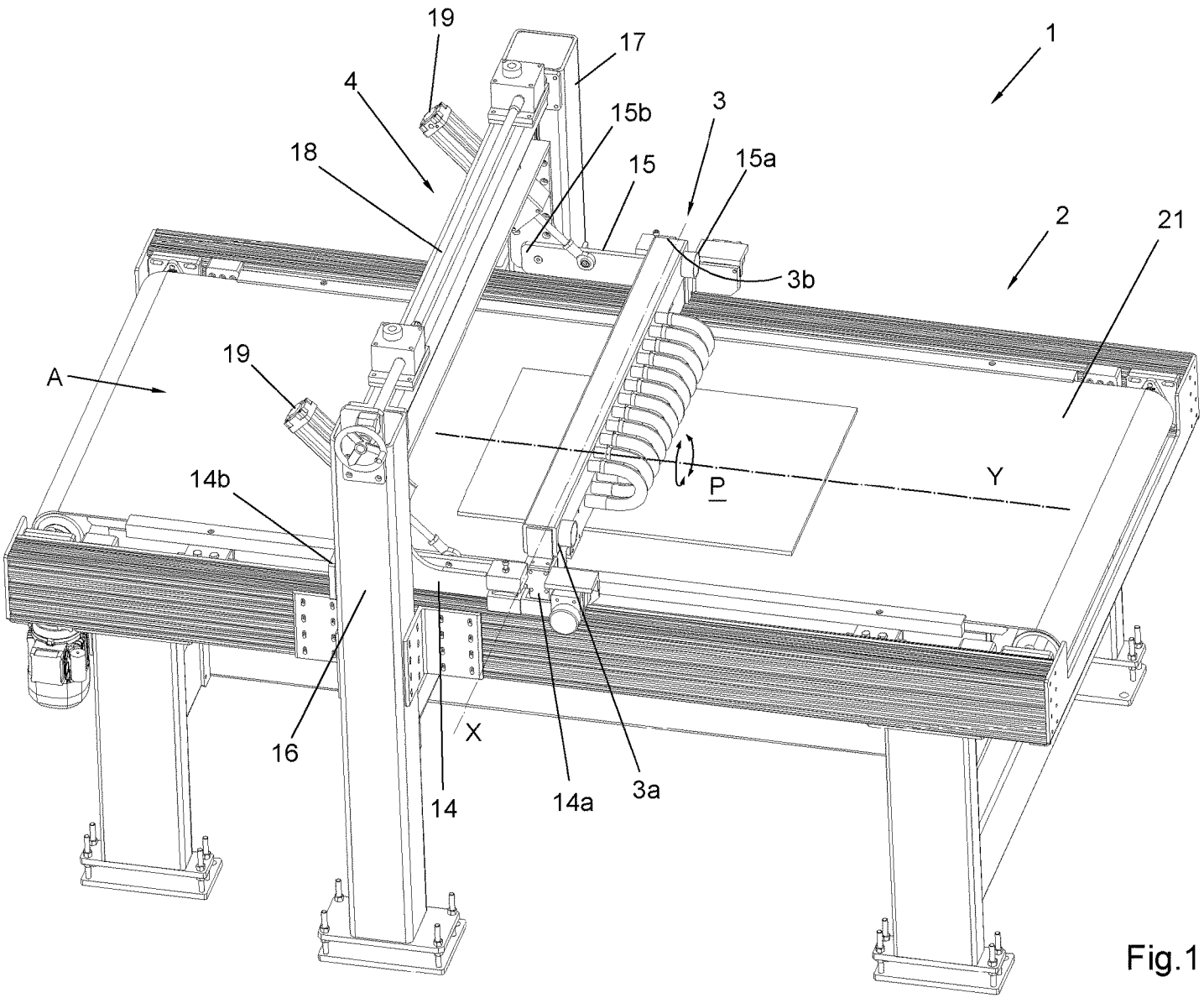
FIG. 1 shows an axonometric view of the coating device, in particular for painting, according to a first preferred embodiment of the invention.
Figure 2:
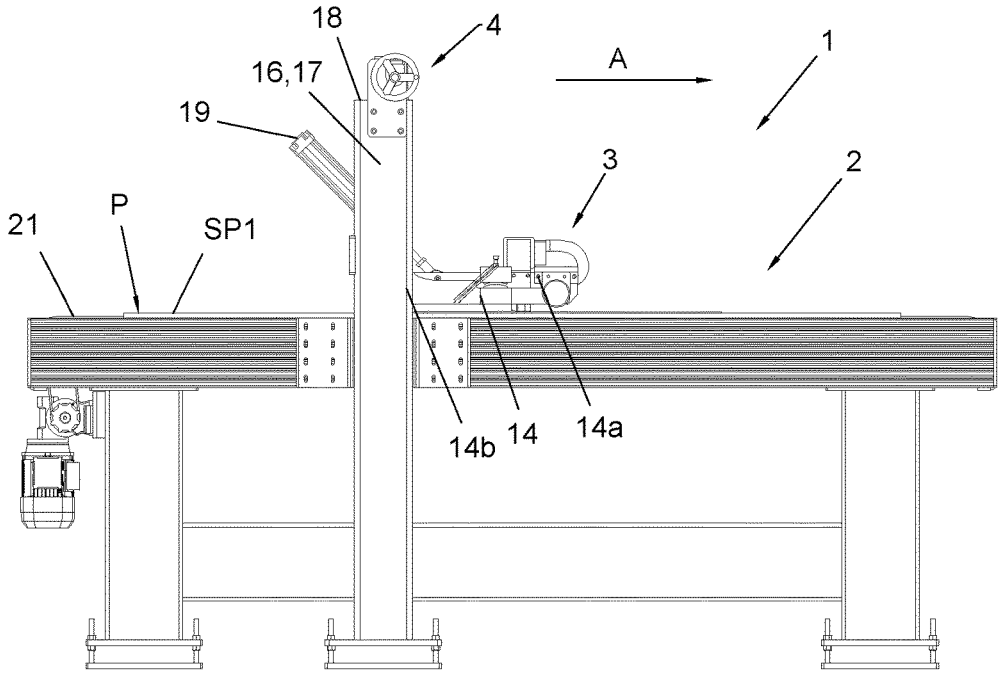
FIG. 2 shows a side view of the device of FIG. 1.
Figure 3:
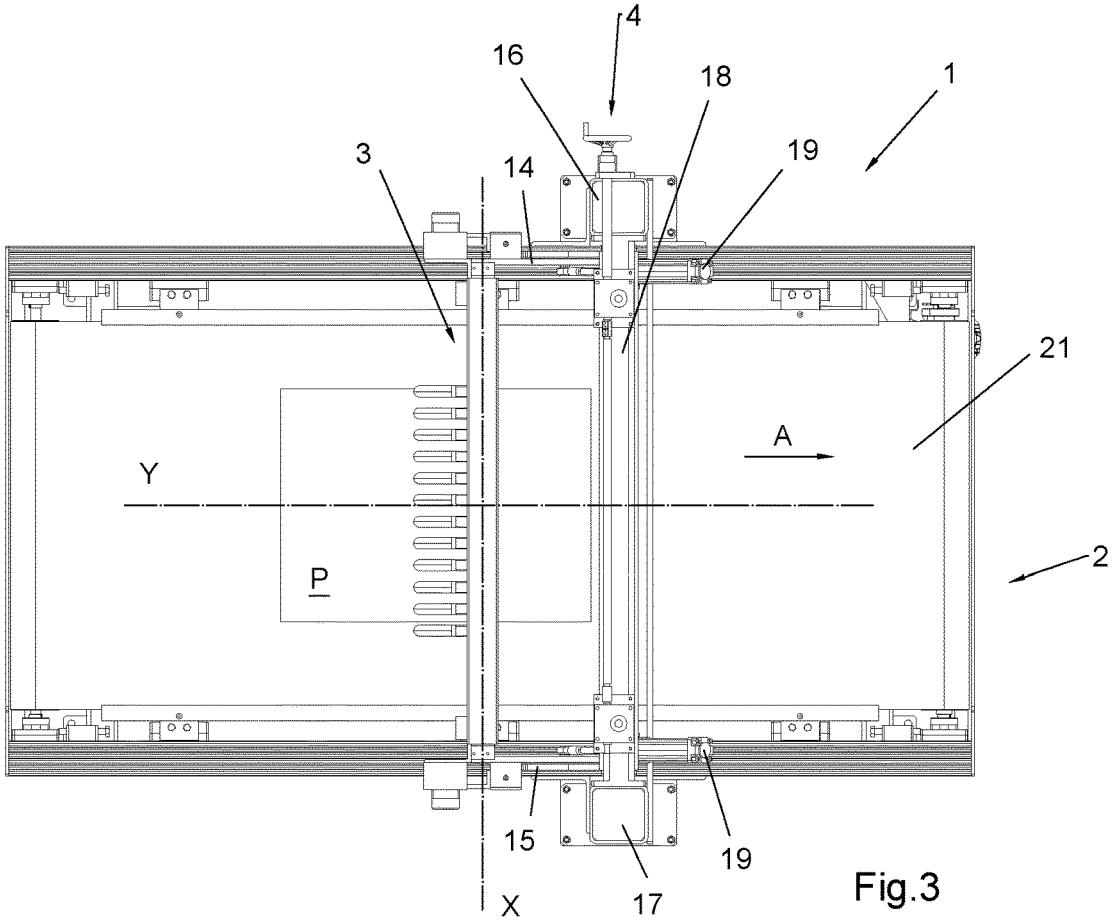
FIG. 3 shows a top view of the device of FIG. 1.
Figure 4:
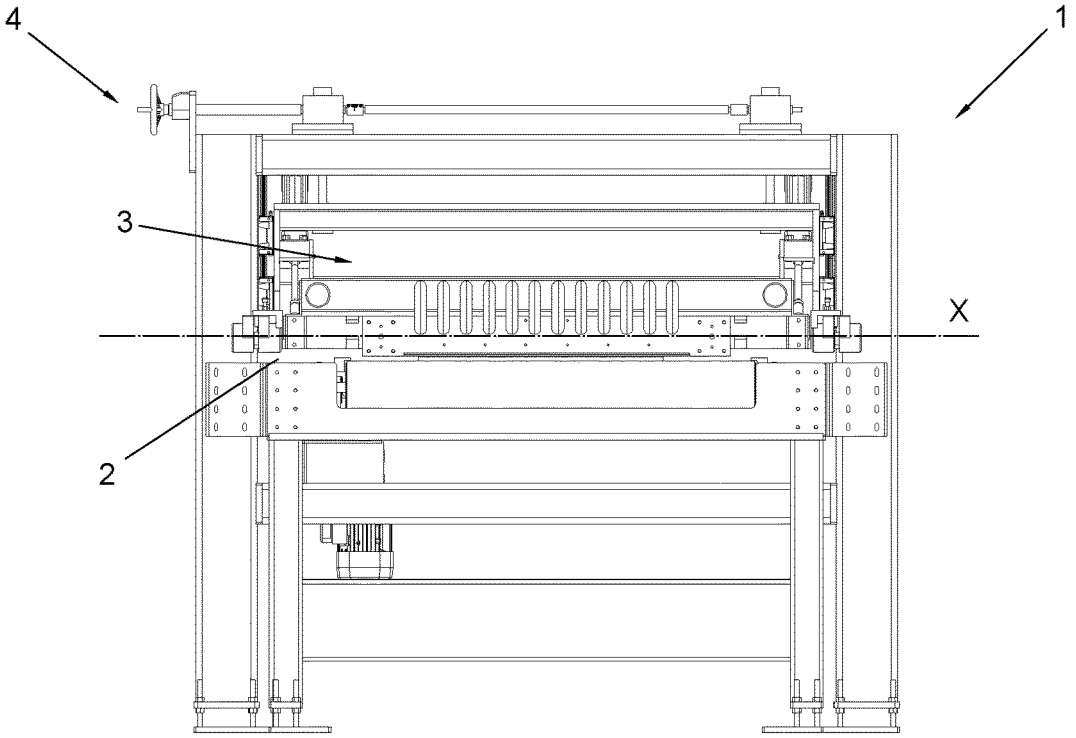
FIG. 4 shows a front view of the device of FIG. 1.

The above-mentioned device 1, as shown in FIG. 1, comprises a substantially horizontal support surface 2 to support a rigid panel P to be treated.

Figure 5:
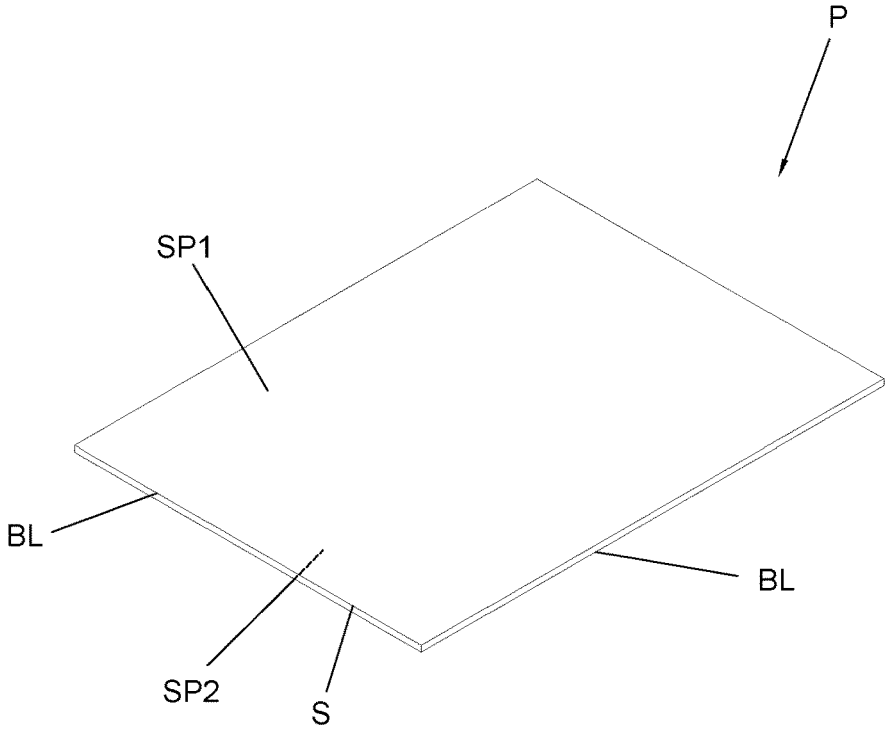
FIG. 5 shows an axonometric view of a rigid panel.

As previously stated, the term "panel" P refers to a flat element in which two large surfaces are identified, parallel to each other, defined as main surfaces SP1 and SP2, between which there are lateral edges BL, as shown in FIG. 5.

These rigid panels P, as already said, may be made of wood, chipboard, plastic material or the like.

Figure 6:
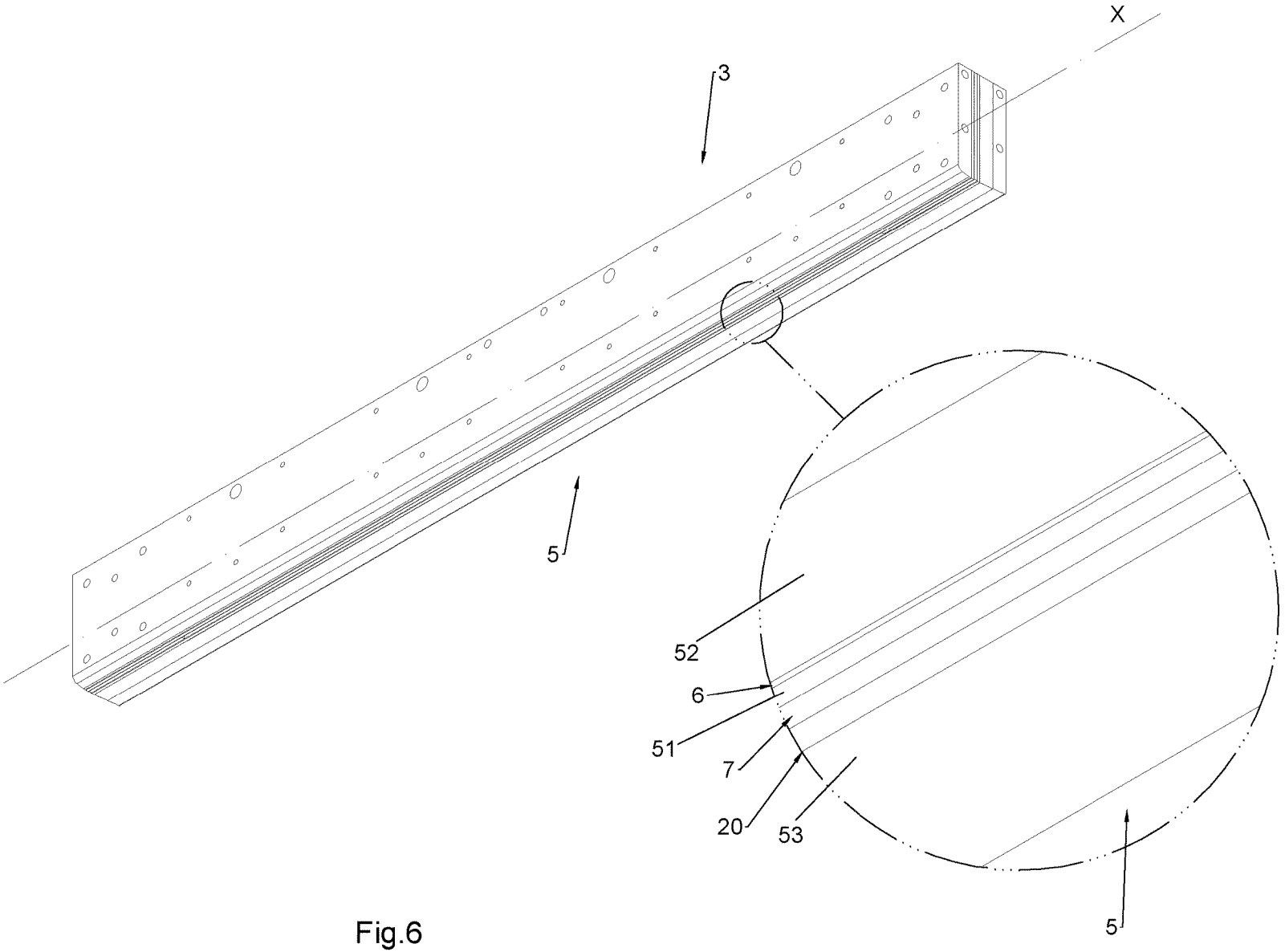
FIG. 6 shows an axonometric view of the painting head according to a first preferred embodiment of the invention pertaining to the device of FIG. 1.

The device 1 of the invention, according to the first preferred embodiment, also comprises a painting head 3 which extends substantially along a longitudinal direction X, as can be seen in the detail of FIG. 6. The painting head 3 is located in the device 1 orthogonally to the direction of relative movement, indicated by A in FIGS. 1, 2 and 3, above the support surface 2 and the panel P placed on it.

According to the preferred embodiment described herein, the support surface 2 on which the panel P rests is a conveyor belt 21 configured to move the panel P forward along the above-mentioned movement direction A in the direction indicated by the arrow, while the painting head 3 is fixed by means of an arched structure 4 above the aforesaid support surface 2 so that the painting head 3 is, according to the longitudinal direction X, in a substantially fixed position during processing.

It is not excluded, however, that according to an alternative embodiment, the device comprises a static support surface 2, and therefore the panel P, once it has been rested on such support surface 2, is in turn kept in a fixed position, while the painting head 3 is connected to the aforesaid arched frame 4 in such a way as to be able to move relative to the support surface 2, and thus the panel P along said direction of movement A.

Therefore, regardless of how the device 1 of the invention is structured, it is important that it allows the relative movement between the painting head 3 and the panel P, the main surface SP1 of which must be covered, preferably painted.

Returning to the description of the first preferred embodiment of the invention, shown in FIGS. 1 to 4, according to a vertical section plane orthogonal to said longitudinal direction X and taking as a reference the direction of forward movement indicated by the arrow in the figures in question, the painting head 3 has on its face 5 suitable to be placed facing, during processing, the support surface 2 and therefore the main surface SP1 of the panel P, a dispensing outlet 6 having a substantially longitudinal development, for the delivery of a liquid product, and an suction inlet 7 with a substantially longitudinal development, for the suction of this liquid product in-series. As seen above, this suction creates a veil of the liquid product between the two aforesaid mouths 6 and 7 and in contact with said main surface SP1. The vertical section of the painting head 3 is shown in FIG. 7.

Figure 7:
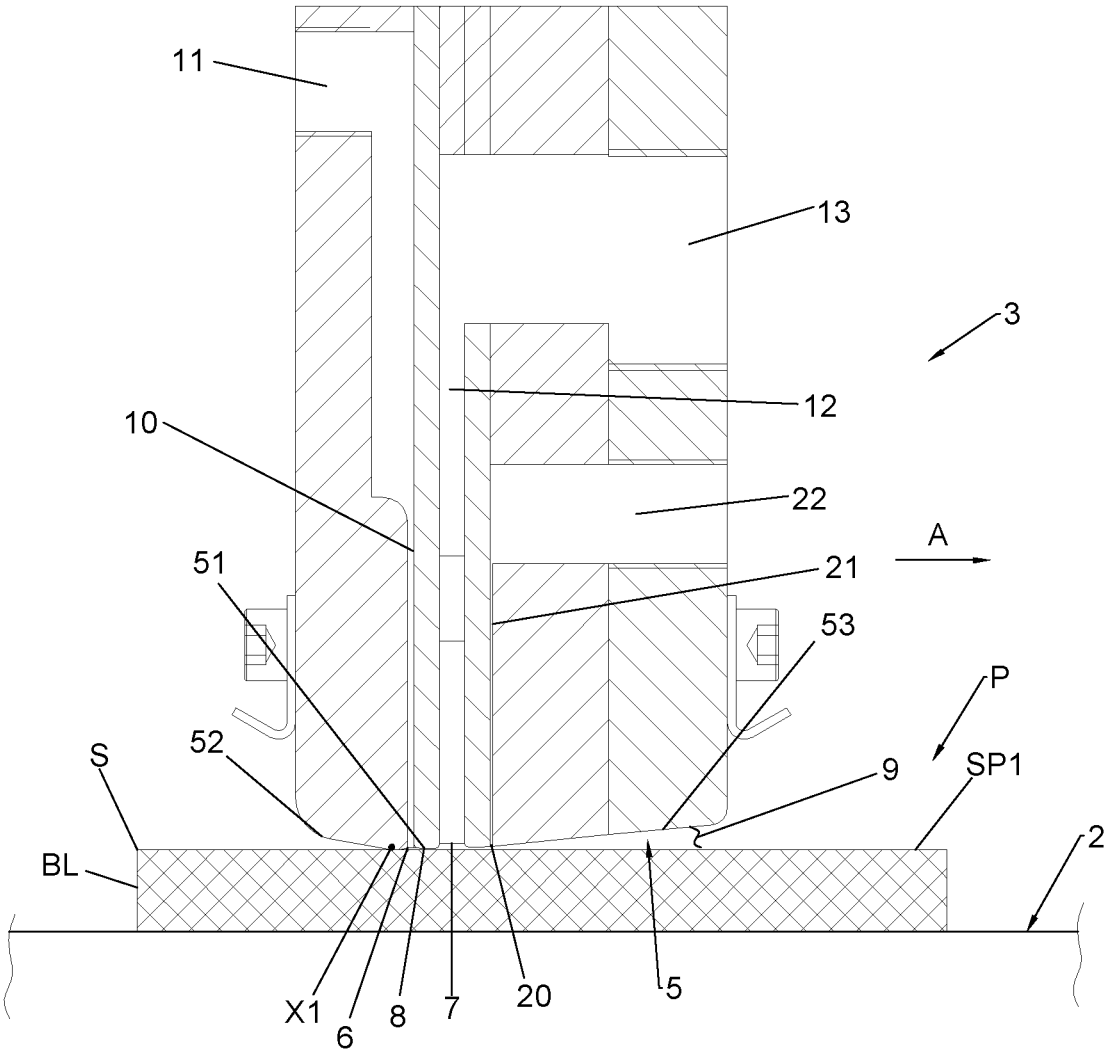
FIG. 7 shows the painting head in cross-section, according to a vertical section plane, according to a first preferred embodiment of the invention, resting on a main surface of a panel.

In particular, preferably, starting from the left side of FIG. 7 and taking as a reference the direction of movement indicated by the arrow A, the dispensing outlet 6 precedes the suction inlet 7 so that the direction of the flow of the liquid product between the two mouths substantially corresponds with the above-mentioned direction of movement A of the panel P.

Figure 8:
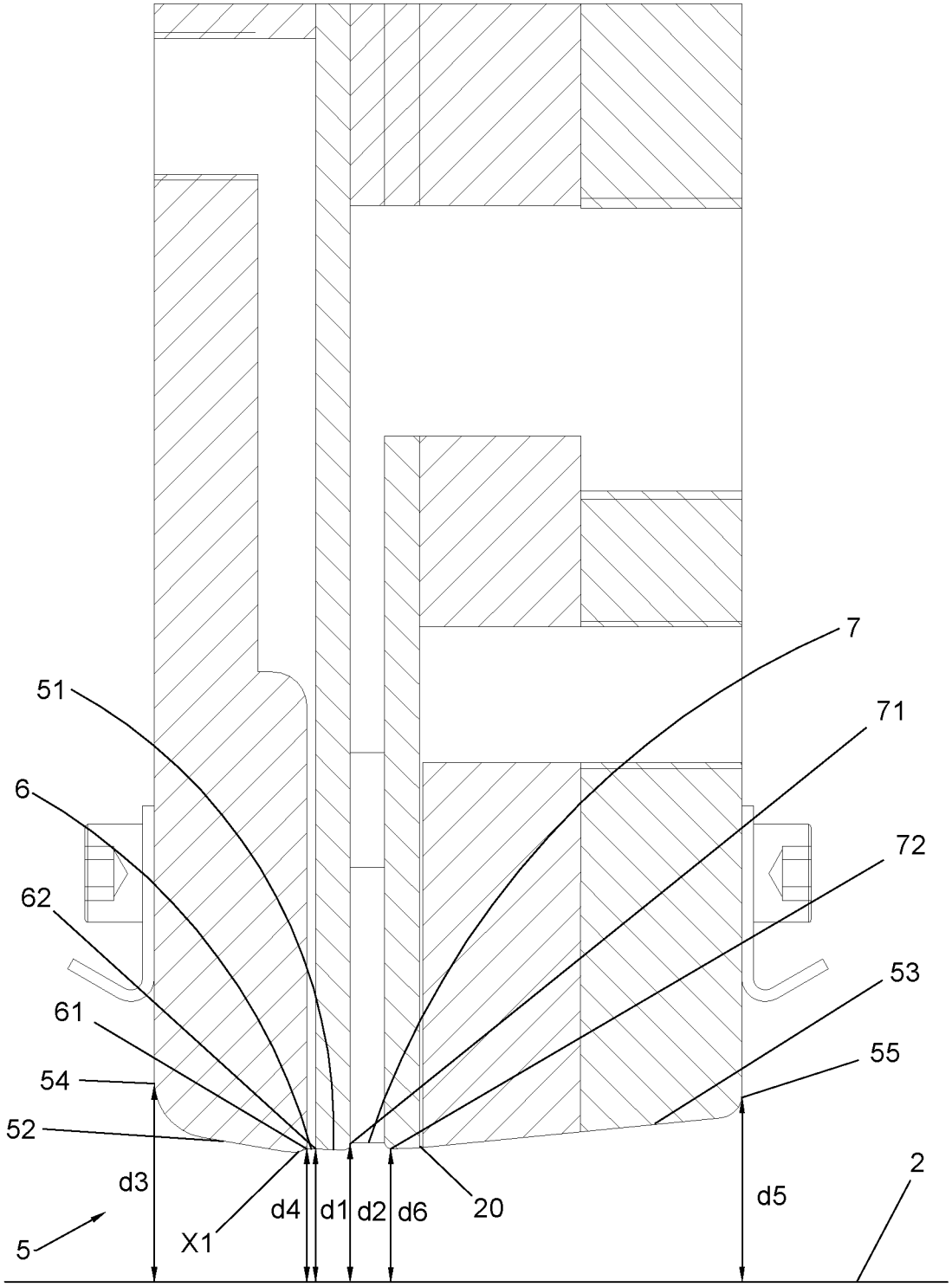
FIGS. 8 and 9 both show details of the section of FIG. 7.

According to the first embodiment of the invention, as shown in the section in FIG. 8 of the painting head 3, the first side surface 52 of the face 5, defined between the first end 54 of the same face 5 and the first end 61 of the dispensing outlet 6, is configured so that the distance d4 between one of the points located around the same first end 61 of the dispensing outlet 6 and the support surface 2 is less than the distance dx between any other point belonging to the face 5 and the support surface 2.

In particular, this distance d4, according to the invention, is smaller than the distance dx of any point of the intermediate surface 51 of the face 5 from the support surface, defined between the dispensing outlet 6 and the suction inlet 7, and smaller than the distance dx of any point of the second side surface 53 of the face 5 from the support surface, defined between the second end 55 of the same face 5 and the second end 72 of the suction inlet 7.

This characteristic advantageously allows the painting head 3 to rest on the main surface SP1 of the panel P, during the forward movement of the latter, only at one of the points located around the above-mentioned first end 61. In particular, the latter progressively touches the various areas of the main surface SP1, during the forward movement of the panel P, before those areas are covered by the liquid product. Therefore, advantageously, no part of the painting head 3 touches an area of the same main surface SP1 after the same area has been painted.

Advantageously, this allows, during processing, the definition above the main surface SP1 of the panel P and below the intermediate surface 51, thus between the dispensing outlet 6 and the suction inlet 7, of an empty channel 8 which extends substantially over the entire length of the painting head 3.

The aforesaid empty channel 8 advantageously favors the process of suction of the liquid product by the suction inlet 7.

This optimization, therefore, of the suction process allows the flow of the liquid product between the two mouths 6 and 7 to be kept constant and uniform, even in the presence of irregularities on the aforesaid main surface SP1 of the panel 2.

In other words, even in the case in which the main surface SP1 is not totally flat, but for example is undulated or warped, and therefore if some of its points are at different distances from the above-mentioned dispensing outlet 6, the definition of the aforesaid empty channel 8, enabling the flow of the aforesaid liquid product to be maintained constant and uniform between the two mouths, would in any case compensate for such possible differences. Consequently, advantageously, this characteristic enables the coating, in particular the painting, of the above-mentioned main surface SP1 to remain substantially constant over time and therefore along the direction of movement A and uniform throughout the length of the painting head 3 and therefore throughout the width of the panel P.

In other words, this characteristic of the painting head 3 of the device 1 of the invention makes it possible to prevent the appearance on the main surfaces SP1 and SP2 of the rigid panels P of strips or bands with an accumulation of liquid product greater than the accumulation that is found on adjacent strips or bands.

Moreover, the fact that the distances dx between each point of the second side surface 53 and the support surface 2 are also greater than the above-mentioned distance d4, allows, during the working phase, that is when the painting head 3 rests on the main surface SP1 of the rigid panel P at the above-mentioned point around the first end 61, the definition of a further empty channel 9, indicated in FIG. 7, between the second end 72 of the suction inlet 7 and the second end 55 of the face 5, which extends over the entire length of the painting head 3. This further empty channel 9 ensures the constant and adequate flow of air towards the suction inlet 7. Consequently, and advantageously, this aspect contributes to favoring a constant and uniform suction by the suction inlet 7 of the liquid product dispensed from the dispensing outlet 6.

Furthermore, when the painting head 3 reaches the edge of the main surface SP1, in particular the above-mentioned first end 61 of the dispensing outlet 6 reaches the corner S of the panel P between the main surface SP1 and the side edge BL, there could be the risk of the intermediate surface 51 touching the already painted corner S, degrading the aesthetic appearance of the latter.

However, the presence of the aforesaid vertical gap, particularly between the two ends 61 and 62 of the dispensing outlet 6, due to the fact that the distance d4 is less than the distance dx of any point of the intermediate surface 51 and of the second side surface 53 from the support surface, substantially favors the removal of the panel P from the painting head 3 before the aforesaid intermediate surface 51 is lowered at the level of the corner S of the surface SP1.

Preferably, according to the first embodiment of the device 1 of the invention shown in FIG. 7, along the entire length of the painting head 3 in the longitudinal direction X, the distance d1 between the second end 62 of the dispensing outlet 6 and the support surface 2, where the second end 62 of the dispensing outlet corresponds to a first end of the intermediate surface 51 of the face 5, is greater than the distance d2 between the first end 71 of the suction inlet 7 and the aforesaid support surface 2, where the first end 71 corresponds to the second end of the same intermediate surface 51.

Even more precisely, all the points of said intermediate surface 51 defined between the second end 62 of the dispensing outlet 6 and the first end 71 of the suction inlet 7 are positioned at a distance dx with respect to the support surface 2 between the distance d1 and the distance d2.

This configuration allows the intermediate surface 51, when the painting head 3 reaches the edge of the main surface SP1, in particular when the above-mentioned first end 61 of the dispensing outlet 6 reaches the corner S of the panel P between the main surface SP1 and the lateral edge BL, to act as a sort of spatula that evens out any excess paint that might accumulate on the above-mentioned side edge BL.

In fact, in this area of the end of the panel P the most critical points are encountered in performing, on the part of the painting head 3, the correct and homogeneous distribution of the paint, since the painting head 3 moves from a resting position on the main surface SP1 of the panel P to a non-resting position on the same main surface SP1.

Figure 9:
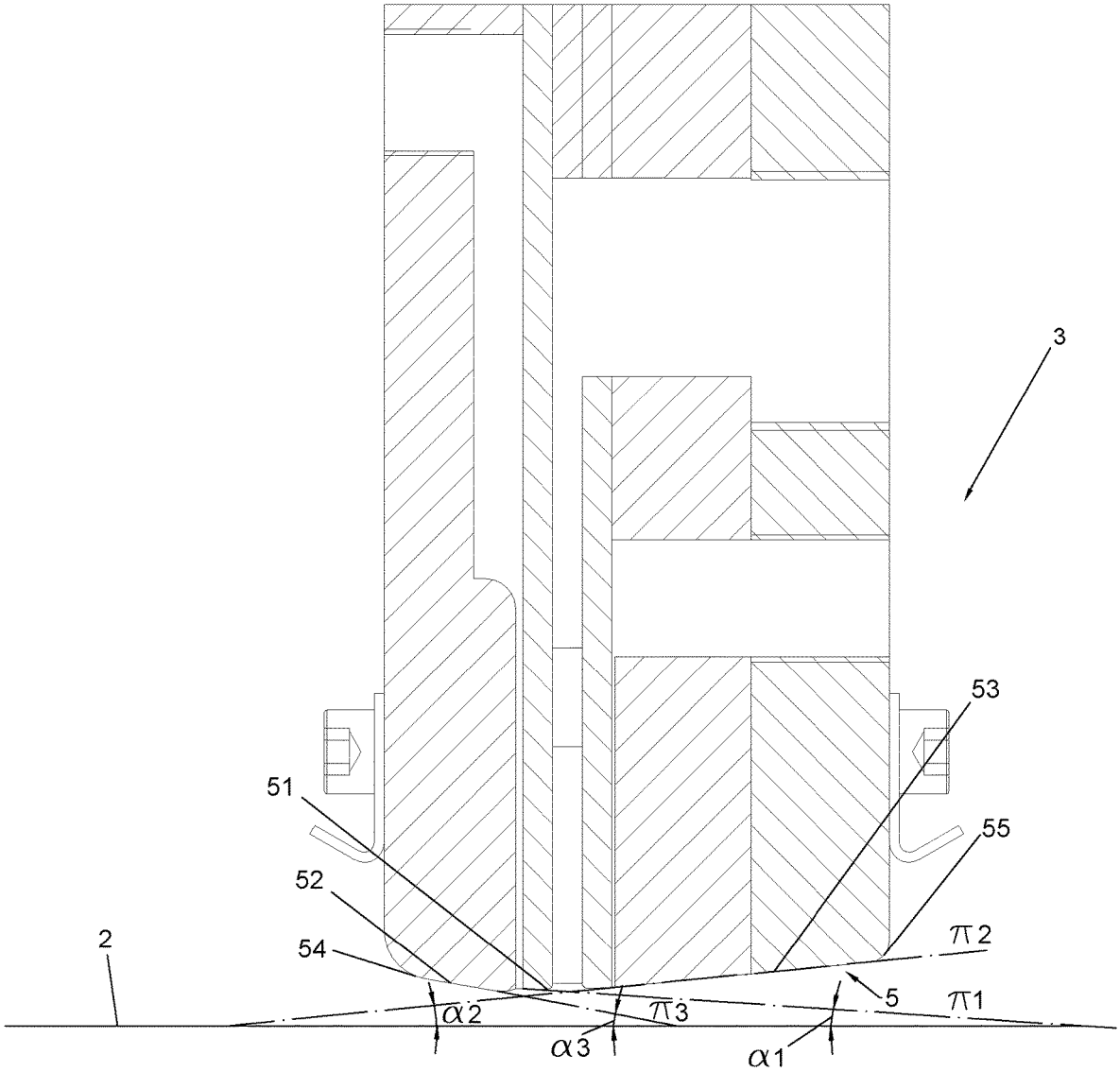

Preferably but not necessarily, according to the preferred embodiment of the invention, as shown in FIG. 9, this intermediate surface 51 rests on a first inclined plane $\pi 1$ with respect to the support surface 2. Still more precisely, this first inclined plane $\pi 1$, on which the intermediate surface 51 rests, intersects the support surface 2, defining a first oriented angle $\alpha 1$ negative with respect to the support surface 2 itself.

It should be noted that oriented angle, by definition and in particular in the present context, means an angle generated by a rotation of the starting side (in this case the support surface 2) around the vertex up to the ending side (in this case the three surfaces 51, 52 and 53 of the face 5). An oriented angle is said to be positive if the rotation is in the anti-clockwise direction, negative if in the clockwise direction.

It is not excluded that, according to different embodiments of the invention, this intermediate surface 51 does not rest on a plane, but is instead defined as a curve, provided however that it is in turn able to define the empty channel 8.

Likewise, preferably, according to the first embodiment of the device 1 of the invention shown in FIG. 8, the painting head 3 is configured so that the distance d5 between the second end 55 of the face 5 and the support surface 2 is greater than the distance d6 between the above-mentioned second end 72 of the suction inlet 7 and the support surface 2.

Even more specifically, the preferred embodiment of the invention provides that all the points of the second side surface 53 defined between the second end 55 of the face 5 and the second end 72 of the suction inlet 7 are positioned at a distance dx from the support surface 2 between the distance d5 and the distance d6.

This characteristic enables the definition of the above-mentioned empty channel 9 with a shape such as to optimize the above-mentioned air flow towards the aforesaid suction inlet 7, further favoring the constant and uniform suction by the suction inlet 7 of the liquid product dispensed from the dispensing outlet 6 in order to obtain a homogeneous deposition of the liquid product on the main surface SP1 or SP2 of the panel P.

According to the above-mentioned first preferred embodiment of the invention described herein, this second side surface 53 lies on a second inclined plane π2 with respect to the support surface 2. Even more in detail, this second inclined plane π2, on which the second side surface 53 lies, intersects with the support surface 2 defining a second oriented angle α2 positive with respect to the support surface 2.

It is not excluded, however, that, in alternative embodiments of the invention with respect to the first preferred embodiment, this difference in distance from the support surface 2 between the second end 72 of the suction inlet 7 and the second end 55 of the face 5 may not be defined.

Also, it is not excluded that in further alternative embodiments of the invention, this second side surface 53 may not lie on the aforesaid second inclined plane π2, but instead have a curved configuration, as long as this allows the definition of the above-mentioned further empty channel 9.

The first preferred embodiment of the invention described herein further envisages that the first side surface 52 of the face 5, defined between a first end 54 of the face 5 itself and the first end 61 of the dispensing outlet 6, is configured so that the distance d3 between the first end 54 of the aforesaid face 5 and the support surface 2 is greater than the distance d4 between the first end 61 of the dispensing outlet 6 and the support surface 2 itself.

More precisely and preferably, all the points of the above-mentioned first side surface 52 defined between the first end 54 of the face 5 and the first end 61 of the dispensing outlet 6 are positioned at a distance dx from the support surface 2 comprised between the distance d3 and the distance d4.

This geometric characteristic of the above-mentioned first side surface 52 enables the rotation, during calibration, of the painting head 3 along an axis of rotation X1 parallel to the longitudinal development axis X and passing substantially through the point around the first end 62 of the dispensing outlet 6 from which the above-mentioned distance d4 is measured.

The advantage of being able to perform this rotation of the painting head 3 is the fact that, in an easy and rapid manner before the start of the processing of the panel P, an operator can adjust the volume of the above-mentioned empty channels 8 and 9 and therefore, respectively, the flow rate of the liquid product that will flow between the dispensing outlet 6 and the suction inlet 7 and the flow rate of the air entering the same suction inlet 7.

This fine adjustment thus advantageously enables the painting head 3 to be adjusted according to the type of liquid product used and/or to the type of panel P to be treated.

Preferably but not necessarily, according to the preferred embodiment of the invention, this first side surface 52 lies on a third inclined plane π3 with respect to the support surface 2.

Even more specifically, the above-mentioned third inclined plane π3, on which the first side surface 52 lies, intersects the support surface 2 defining a third oriented angle α3 negative with respect to the support surface 2 itself.

It is not excluded that, according to different embodiments of the invention, the first side surface 52 is substantially parallel to the support surface 2, and therefore it is not excluded that the device 1 of the invention does not allow for the possibility of tilting the painting head 3 to adjust it. In fact, in this case if the side surface 5 were positioned horizontally when the painting head 3 is placed in contact with the main surface SP1, there would be no margin to be able to rotate the painting head 3 around the above-mentioned axis of rotation X1.

Furthermore, it is not excluded that the above-mentioned first side surface 52 may not lie on a plane, but rather it may have a curved configuration, provided that, in this case, it enables the aforesaid rotation to be performed and therefore the painting head 3 to be adjusted.

The above-mentioned first preferred embodiment of the device 1 of the invention further envisages that on the face 5 of the painting head 3 a second dispensing outlet 20 is defined with a substantially longitudinal development. More specifically, this second dispensing outlet 20 is defined on the aforesaid second side surface 53 between the suction inlet 7 and the second end 55 of the second side surface 53.

According to the invention, compressed air is supplied from the second dispensing outlet 20 during processing, if necessary, to compensate for any shortage or lack of inflow of air from the external environment through the second empty channel 9. In other words, this second dispensing outlet 20 has the function of further facilitating the maintenance of constant and uniform suction by the suction inlet 7 of the liquid product supplied by the dispensing outlet 6.

It is not excluded, however, that in alternative embodiments of the invention this second dispensing outlet is not defined on the face 5 of the painting head 3.

Returning to the first embodiment of the invention, as shown in FIG. 7, the painting head 3 is configured in such a way that the dispensing outlet 6 is operatively connected by means of a supply duct 10 to a reservoir 11 for the storage of a quantity of liquid product necessary and sufficient to dispense it continuously and uniformly.

In particular, for this purpose both the supply duct 10 and the reservoir 11 extend longitudinally for a length substantially equal to the length of the dispensing outlet 6 in such a way as to enable the continuous and uniform flow of the liquid product along the entire length of the dispensing outlet 6 over time.

In the same way, according to the above-mentioned first preferred embodiment of the invention, the suction inlet 7 is operatively connected by means of a suction duct 12 to a suction reservoir 13. In particular, the suction duct 12 and the suction reservoir 13 extend, according to the preferred embodiment of the invention, longitudinally for a length substantially equal to the length of the suction inlet 7 so as to enable a continuous and uniform suction over time along the entire length of the suction inlet 7.

Furthermore, also as regards the second dispensing outlet 20, the above-mentioned first preferred embodiment of the invention provides for it to be operatively connected by means of a second delivery duct 21 to a second reservoir 22 for the storage of compressed air and to a system to release the latter.

Finally, always according to the first preferred embodiment of the invention, the difference between the distance d4 and the distance d1 is around 3 mm, the difference between the distance d1 and the distance d2 is around 1 mm, the difference between the distance d6 and the distance d2 is equal to 1 mm, the intermediate surface is defined with a width of approximately 3 cm, the suction inlet too is defined with a width of approximately 3 cm, like the distance between the second end 72 of the suction inlet 7 and the second dispensing outlet 20, and finally the paint dispensing outlet 6 is defined with a width of approximately 7.5 mm.

According to an alternative embodiment of the painting head 3 not shown in the figures, this could be connected in its front part, according to the direction of movement A, to a support roller.

This support roller, in particular, would be configured to keep the painting head 3 raised with respect to the panel P to be painted so that none of the points of the surface 5 rest on the main surface SP1 or SP2 of the panel P. This configuration would be necessary when the main surface SP1 or SP2 of panel P had already been painted with a protective paint and the painting head would be used to deposit the finishing paint layer. In fact, in this situation, in order to prevent the sliding contact of the painting head 3 on the main surface SP1 or SP2 from compromising the integrity of the above-mentioned layer of protective paint, it would be necessary to use this support roller.

As regards the coupling system between the painting head 3 and the arched structure 4 which supports it above the support surface 2, as can be seen in FIG. 1, it is preferably a floating-type coupling system, which therefore allows the painting head 3, once placed in a working position, to have a certain degree of freedom of movement substantially in a vertical direction with respect to the support surface 2 so as to be able to follow, once resting on the main surface SP1 of the panel P, any discontinuities present on the latter precisely in the vertical direction.

In particular, this coupling system connects the lateral ends 3*a* and 3*b* of the painting head 3 to the first ends 14*a* and 15*a* of two longitudinal members 14 and 15. In contrast, the opposite ends 14*b* and 15*b* of these longitudinal members 14 and 15 are hinged substantially on the lower part of the uprights 16 and 17 pertaining to the above-mentioned arched structure 4.

Furthermore, these longitudinal members 14 and 15 are connected to the crosspiece 18 of the arched structure 4 by means of shock absorption means 19 able to guide the oscillation of the painting head 3 itself.

Furthermore, according to the above-mentioned first preferred embodiment of the invention, the painting head 3 is connected to the above-mentioned first ends 14*a* and 15*a* of the longitudinal members 14 and 15 so as to allow the rotation of the painting head 3 around a centrally defined rotation axis Y and parallel to the direction of movement A.

This further feature allows the painting head 3 to be able to adapt, during processing, to any irregularities present on the main surface SP1 according to a substantially horizontal direction and orthogonal with respect to the direction of movement A.

Finally, as previously said, this painting head 3 is preferably able to be rotated with respect to the aforesaid longitudinal members 14 and 15 according to an axis of rotation substantially corresponding to the longitudinal axis X of the painting head 3 itself.

In fact, this enables the definition, during configuration, of the distances of the suction inlets 6 and of the dispensing outlet 7 from the main surface SP1 to be treated, as well as of the dimensions of the above-mentioned two empty channels 8 and 9 in order to suitably and easily adjust the flow rate of the liquid product flowing between the aforesaid two mouths 6 and 7.

A second preferred embodiment of the device of the invention will now be described, more specifically, a second embodiment of the painting head of the above-mentioned device, indicated in FIGS. 10 to 13 with 103.

This second embodiment of the invention, unless otherwise specified, has the same characteristics as the first embodiment described above. In this regard, all the features of the first embodiment of the invention which are considered to be verifiable also in the second embodiment of the invention, described shortly, will be indicated in FIGS. 10 to 13 and in the following description with the same numerical reference used for the first embodiment of the invention, increased by 100.

In detail, this second embodiment differs, with respect to the first embodiment described above, substantially in the configuration of the lower face 105 of the painting head 103, as shown in FIGS. 10 to 13.

In particular, the aforesaid painting head 103, in correspondence with the above-mentioned face 105, at least for a first segment 123 along the longitudinal direction X, envisages that the distance d1 between the second end 162 of the dispensing outlet 106 and the support surface 102, where the second end 162 of the dispensing outlet corresponds to a first end of the intermediate surface 151 of the face 105, is greater than or equal to the distance d2 between the first end 171 of the suction inlet 107 and the aforesaid support surface 102, where the first end 171 corresponds to the second end of the same intermediate surface 151.

Figure 10:
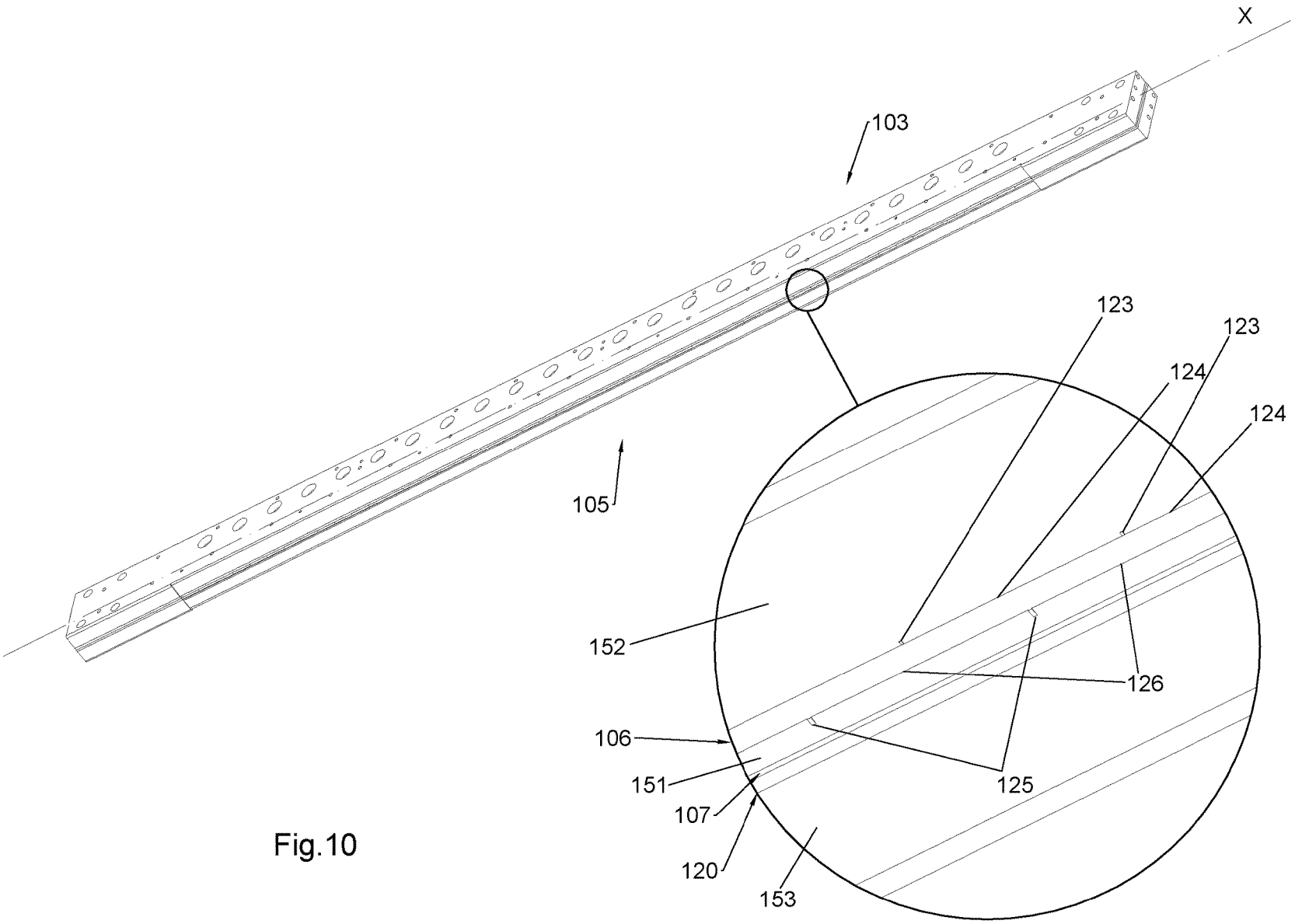
FIG. 10 shows an axonometric view of the painting head of the invention according to a second preferred embodiment.
Figure 11:
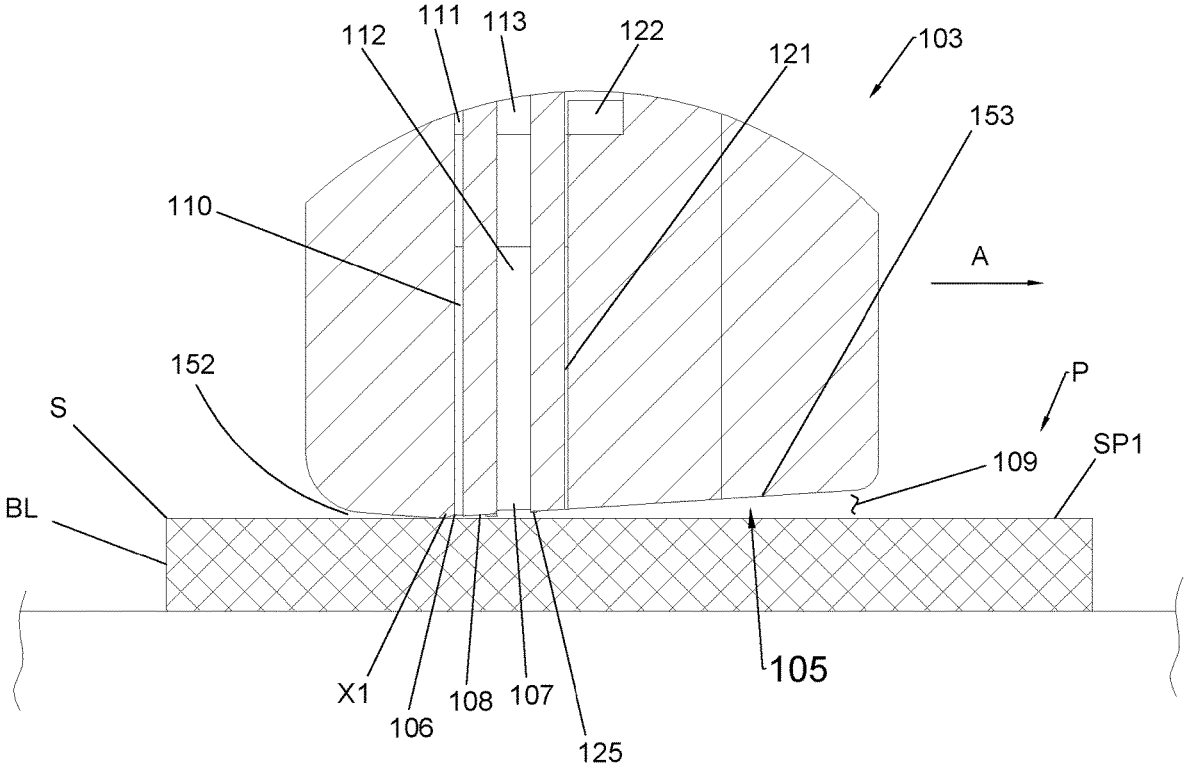
FIG. 11 is a cross-sectional view, according to a vertical section plane, of the painting head of the invention resting on a main surface of a panel, according to a second preferred embodiment.
Figure 12:
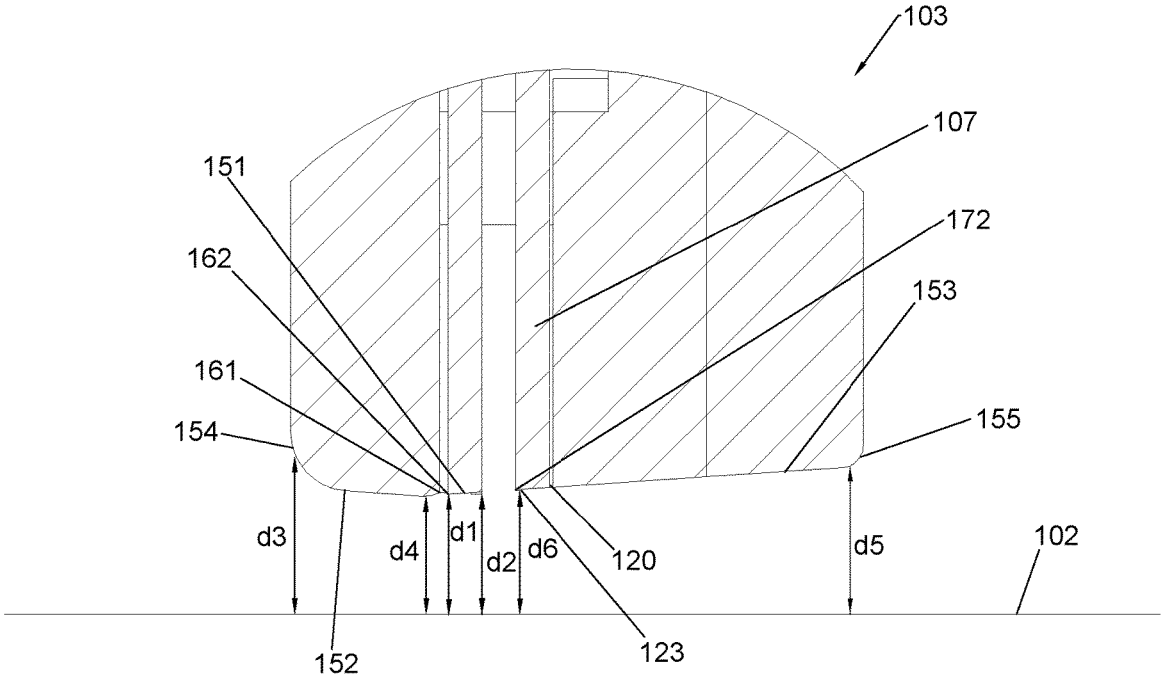
FIGS. 12 and 13 both show details of the section of FIG. 11.

According to this second preferred embodiment of the invention described herein, a plurality of the aforesaid first segments 123 is defined on the painting head 103 wherein the distance d1 is greater than or equal to the distance d2, these first segments 123 being spaced apart from each other, as shown in FIG. 10.

More precisely, preferably but not necessarily, each of the above-mentioned first segments 123 has a width, according to the longitudinal direction X, between 1 cm and 5 cm.

As regards the remaining segments 124 of the intermediate surface 151 of the painting head 103 along the aforesaid longitudinal direction X in which the first segments 123 are not defined, they are shaped so that the distance d1 between the second end 162 of the dispensing outlet 106 and the support surface 102 is smaller than the distance d2 between the first end 171 of the suction inlet 107 and the above-mentioned support surface 102.

Even more precisely, in correspondence with these remaining segments 124, all points of the aforesaid intermediate surface 151 defined between the second end 162 of the dispensing outlet 106 and the first end 171 of the suction inlet 107 are placed at a distance dx with respect to the support surface 102 between the distance d1 and the distance d2.

This configuration, and in particular the presence of one or more of the aforesaid first segments 123, advantageously prevents, when the painting head 103 reaches the edge of the main surface SP1, in particular when the above-mentioned first end 161 of the dispensing outlet 106 reaches the corner S of the panel P between the main surface SP1 and the side edge BL, the intermediate surface 151 from hitting the entire length of the painting head 103 against the side edge BL of the panel P. On the contrary, with this configuration, this side edge BL will come into contact only and exclusively with the above-mentioned first segments 123.

This advantageously prevents the painting head 103 of the invention, at the end of the panel P, from invalidating the homogeneity of the distribution of the paint in an extended manner along the above-mentioned side edge BL.

Incidentally, it is important to point out that the embodiment just described which provides for the definition of the above-mentioned plurality of segments 123 along the longitudinal direction X at the second end 162 could itself be the subject of a claim without the first side surface 152 of the face 105 defined between a first end 154 and the dispensing outlet 106 having to be configured in such a way that the distance d4 is less than the distance dx between any other point belonging to the face 105 and the support surface 102. In fact, the presence of the segments 123 alone enables the above-mentioned technical advantages to be achieved.

Figure 13:
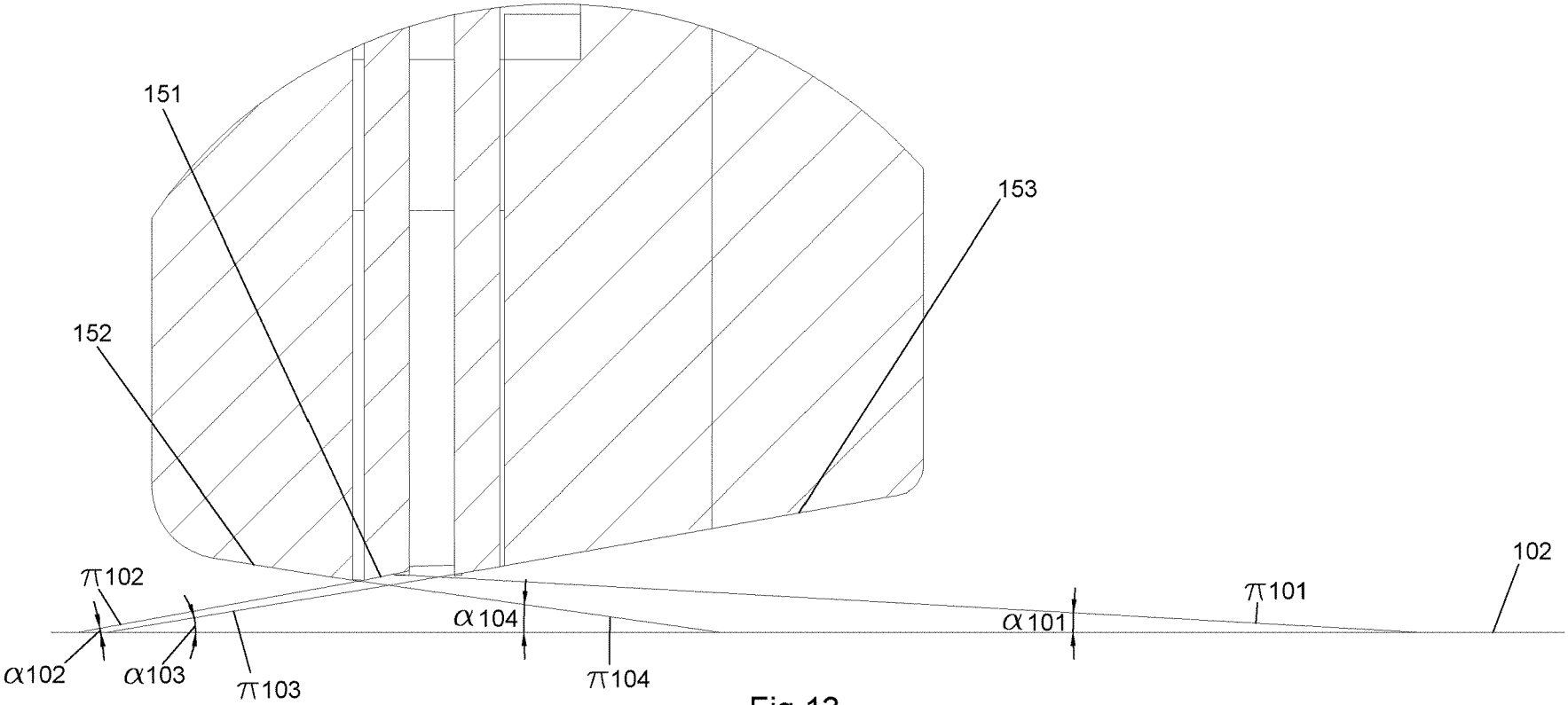

Preferably but not necessarily, according to the preferred embodiment of the invention, as shown in FIG. 13, in correspondence with the aforesaid first segments 123, the intermediate surface 151 rests on a first inclined plane π101 with respect to the support surface 102. Even more precisely, in correspondence with these first segments 123, this first inclined plane π101, on which the intermediate surface 151 lies, intersects the support surface 102, defining a first oriented angle α101 which is negative with respect to the support surface 102.

On the contrary, in correspondence with the remaining segments 124 of the intermediate surface 151 in which the aforesaid first segments 123 are not defined, the same intermediate surface 151 lies on a second inclined plane π102 intersecting the support surface 102, defining in this way a second oriented angle α102 which is positive with respect to the support surface 102.

It is specified, once again, that oriented angle, by definition and in particular in the present context, is meant to be an angle generated by a rotation of the starting side (in this case the support surface 102) around the vertex until it reaches the ending side (in this case the three surfaces 151, 152 and 153 of the face 105). An oriented angle is said to be positive if the rotation is in the anti-clockwise direction, negative if in the clockwise direction.

According to the above-mentioned second preferred embodiment of the invention described herein, this second side surface 153 lies on a third inclined plane π103 with respect to the support surface 102. Even more in detail, this third inclined plane π103, on which the second side surface 153 lies, intersects the support surface 102 defining a third oriented angle α103 which is positive with respect to the support surface 102.

It is not excluded, however, that, in alternative embodiments of the invention with respect to the preferred embodiment, this difference in distance from the support surface 102 between the second end 172 of the suction inlet 107 and the second end 155 of the face 105 may not be defined.

Moreover, it is not excluded that in further alternative embodiments of the invention, this second side surface 153 may not lie on the aforesaid third inclined plane π103, but instead have a curved configuration, as long as this allows the definition of the above-mentioned further empty channel 109.

Furthermore, according to the above-mentioned second preferred embodiment of the invention, at the second end 172 of the suction inlet 107, for at least one second segment 125 along the aforesaid longitudinal direction X, the distance d6 between this second segment 125 and the support surface 102 is less than the distance between the remaining second segments 126 in which the aforesaid second segment 125 is not defined at the second end 172 along the above-mentioned longitudinal direction X and the support surface 102 itself. In other words, at the second end 172 according to the longitudinal direction X there is at least one second segment 125 protruding downwards with respect to the remaining second segments 126 of the same second end 172, so that, also in this case, if the painting head 103 should hit the underlying panel P at the level of the second end 172, the panel P would be touched only and exclusively by the aforesaid second segment 125. This configuration, and in particular the presence of the above-mentioned second segment 125, in the same way as the first segments 123 described above, prevents the painting head 103 of the invention, at the end of the panel P, from invalidating the homogeneity of the distribution of the paint in an extended manner along the above-mentioned side edge BL.

According to the preferred embodiment of the invention described herein, there are a plurality of the above-mentioned second segments 125 defined on the painting head 103 protruding downwards, these second segments 125 being spaced apart as shown in FIG. 10.

More precisely, preferably but not necessarily, each of the above-mentioned second segments 125, along the longitudinal direction X, has a width between 0.5 cm and 5 cm.

Additionally, according to the second preferred embodiment of the invention, the plurality of the first segments 123 is staggered with respect to the plurality of the aforesaid second segments 125, along the longitudinal direction X.

It is not excluded, however, that, according to an alternative embodiment, each first segment 123 may be aligned with a corresponding second segment 125 along the above-mentioned longitudinal direction X.

Also for the second preferred embodiment of the invention, the first side surface 152 of the face 105, defined between a first end 154 of the face 105 itself and the first end 161 of the dispensing outlet 106, is configured in such a manner that the distance d3 between the first end 154 of the aforesaid face 105 and the support surface 102 is greater than the distance d4 between the first end 161 of the dispensing outlet 106 and the support surface 102.

More precisely, preferably, all the points of the aforesaid first side surface 152 defined between the first end 154 of the face 105 and the first end 161 of the dispensing outlet 106 are positioned at a distance dx from the support surface 102 between distance d3 and distance d4.

This geometrical characteristic of the above-mentioned first side surface 152, as in the case of the first embodiment of the invention, enables the rotation, during calibration, of the painting head 103 along a rotation axis X1 parallel to the longitudinal development axis X and passing substantially through the point around the first end 162 of the dispensing outlet 106 from which the above-mentioned distance d4 is measured.

The advantage of being able to perform this rotation of the painting head 103 is the fact that, in an easy and rapid manner before the start of the processing of the panel P, an operator can adjust the volume of the above-mentioned empty channels 108 and 109 and therefore respectively the flow rate of the liquid product that will flow between the dispensing outlet 106 and the suction inlet 107 and the flow rate of the air entering the suction inlet 107. This fine adjustment thus advantageously enables the painting head 103 to be adjusted according to the type of liquid product used and/or to the type of panel P to be treated.

Preferably but not necessarily, according to the above-mentioned second preferred embodiment of the invention, the first side surface 152 lies on a fourth inclined plane π104 with respect to the support surface 102.

Even more specifically, the above-mentioned fourth inclined plane π104, on which the first side surface 152 lies, intersects the support surface 102 defining a fourth oriented angle α104 which is negative with respect to the support surface 102.

It is not excluded that, according to different embodiments of the invention, the first side surface 152 is substantially parallel to the support surface 102, and therefore it is not excluded that the device of the invention does not provide for the possibility of tilting the painting head 103 to adjust it. In fact, in this case if this side surface 105 were positioned horizontally when the painting head 103 is placed in contact with the main surface SP1, there would be no margin to be able to rotate the painting head 103 around the above-mentioned axis of rotation X1.

Furthermore, it is not excluded that the above-mentioned first side surface 152 may not lie on a plane, but rather it may have a curved configuration, provided that, in this case, it enables the aforesaid rotation to be performed and therefore the painting head 103 to be adjusted.

Still according to the above-mentioned second preferred embodiment of the invention, the difference between the distance d4 and the distance d1 is selected so that it is around 3 mm, the absolute difference between the distance d1 and the distance d2, both at the level of the first segments 123 and at the level of the remaining first segments 124, is at most equal to 1 mm, the difference between the distance d6 and the distance d2 is equal to 1 mm, the height of the downward protrusion defined in the aforesaid second segments 125 of the second end 172 is around 1.5 mm with respect to the remaining second segments 126, the intermediate surface is defined with a width of approximately 3 cm, the suction inlet too is defined with a width of approximately 3 cm, as is the distance between the second end 172 of the suction inlet 107 and the second dispensing outlet 120, and finally the paint dispensing outlet 106 is defined with a width of approximately 7.5 mm.

As previously stated, all the characteristics explicitly described for the first embodiment of the invention which have not been restated also for the above-mentioned second embodiment, unless otherwise specified, must be considered implicitly present also for the above-mentioned second embodiment of the invention.

According to the foregoing, it is believed that the device 1 of the invention achieves all the set objects.

In particular, the object of constructing a coating device, in particular a painting device, able to distribute a liquid product also on the main surfaces of a rigid panel, is achieved.

Even more particularly, the object of the invention to construct a coating device, in particular a painting device, which is able to uniformly distribute this liquid product on the above-mentioned main surfaces of a rigid panel is achieved.

The invention claimed is:

1. A device for coating with liquid products main surfaces of rigid panels, said device comprising:

a support surface to support one of said rigid panels, said support surface comprising a conveyor belt configured to advance said rigid panels along a direction of relative movement;

an elongated painting head which extends longitudinally along an X direction, said painting head being positioned orthogonally to said direction of relative movement above said support surface, said painting head having an end face facing said support surface, said end face comprising:

an elongated first side surface that extends laterally between a first end and an opposing second end;

an elongated intermediate surface that extends laterally between a first end and an opposing second end;

an elongated second side surface that extends laterally between a first end and an opposing second end;

an elongated dispensing outlet for delivery of a liquid product, said dispensing outlet being disposed between said second end of said first side surface and said first end of said intermediate surface;

an elongated suction inlet for suctioning of said liquid product when delivered through said dispensing outlet, said suction outlet being disposed between said second end of said intermediate surface and said first end of said second side surface;

wherein said end face has a location having a minimal distance between said end face and said support surface, said location being at said second end of said first side surface;

wherein for each of a plurality of first segments of said intermediate surface spaced apart along said X direction, a distance between said first end of said intermediate surface and said support surface is greater than or equal to a distance between said second end of said intermediate surface and said support surface; and wherein for remaining segments of said intermediate surface spaced apart along said X direction in which said first segments are not defined, a distance between said first end of said intermediate surface and said support surface is smaller than a distance between said second end of said intermediate support surface and said support surface.

2. The device according to claim 1, wherein:

on said intermediate surface, at least one of said first segments lies on an inclined first plane intersecting said support surface so as to define a first oriented angle which is negative with respect to said support surface;

on said intermediate surface at least one of said remaining segments lies on an inclined second plane intersecting said support surface so as to define a second oriented angle which is positive with respect to said support surface.

3. The device according to claim 1, wherein each of said plurality of first segments has a width, according to said X direction, between 1 cm and 5 cm.

4. The device according to claim 2, wherein each of said plurality of first segments has a width, according to said X direction, between 1 cm and 5 cm.

5. The device according to claim 1, wherein said first side surface is configured so that a distance d3 between said first end of said first side surface and said support surface is greater than a distance d4 between said second end of said first side surface and said support surface.

6. The device according to claim 2, wherein said first side surface is configured so that a distance d3 between said first end of said first side surface and said support surface is greater than a distance d4 between said second end of said first side surface and said support surface.

7. The device according to claim 3, wherein said first side surface is configured so that a distance d3 between said first end of said first side surface and said support surface is greater than a distance d4 between said second end of said first side surface and said support surface.

8. The device according to claim 5, wherein for all points on said first side surface defined between said first end of said first side surface and said second end of said first side surface, said points are positioned at a distance dx from said support surface that is between said distance d3 and said distance d4.

9. The device according to claim 1, wherein said second side surface is configured so that a distance d5 between said second end of said second side surface and said support surface is greater than a distance d6 between said first end of said second side surface and said support surface.

10. The device according to claim 9, wherein for points on said second side surface defined between said first end of said second side surface and said second end of said second side surface, said points are positioned at a distance dx from said support surface that is between said distance d5 and said distance d6.

11. The device according to claim 9, wherein for at least one second segment of the second side surface extending along said X direction, the distance between said first end of the second side surface and said support surface is less than a distance between said first end of said second side surface and said support surface for a remaining second segment of said second side surface extending along said X direction.

12. The device according to claim 10, wherein for at least one second segment of the second side surface extending along said X direction, a distance between said first end of the second side surface and said support surface is less than a distance between said first end of said second side surface and said support surface for a remaining second segment of said second side surface extending along said direction X.

13. The device according to claim 11, wherein said at least one second segment has a width, according to said X direction, between 0.5 cm and 5 cm.

14. The device according to claim 11, wherein in said painting head said plurality of first segments and a plurality of said second segments are defined, said plurality of first segments being staggered with respect to said plurality of said second segments, along said X direction.

15. The device according to claim 13, wherein in said painting head said plurality of first segments and a plurality of said second segments are defined, said plurality of first segments being staggered with respect to said plurality of said second segments, along said X direction.

16. The device according to claim 1, further comprising a second dispensing outlet extending through said second side surface.

17. The device according to claim 16, wherein:

said dispensing outlet is operatively connected by a delivery duct to a reservoir, said delivery duct and said reservoir extending longitudinally for a length equal to a length of said dispensing outlet so as to allow a continuous and uniform flow of said liquid product over time along an entire length of said dispensing outlet;

said suction inlet is operatively connected by a suction duct to a suction reservoir, said suction duct and said suction reservoir extending longitudinally for a length equal to a length of said suction inlet so as to enable a continuous and uniform suction over time along an entire length of said suction inlet;

said second dispensing outlet is operatively connected by a second delivery duct to a second reservoir to store compressed air and to a system for releasing said compressed air from said second reservoir towards said second dispensing outlet.

* * * * *